US007779804B2

(12) United States Patent
Baker et al.

(10) Patent No.: US 7,779,804 B2
(45) Date of Patent: Aug. 24, 2010

(54) ROCKER ARM ASSEMBLY FOR RADIAL AND AXIAL LOADS

(75) Inventors: Richard Baker, Sterling Heights, MI (US); Ross Gresley, Fort Mill, SC (US); Marion Ince, Mount Holly, NC (US)

(73) Assignee: Schaeffler KG, Herzogenaurach (DE)

( * ) Notice: Subject to any disclaimer, the term of this patent is extended or adjusted under 35 U.S.C. 154(b) by 245 days.

(21) Appl. No.: 11/928,200

(22) Filed: Oct. 30, 2007

(65) Prior Publication Data

US 2008/0098971 A1 May 1, 2008

Related U.S. Application Data

(60) Provisional application No. 60/863,716, filed on Oct. 31, 2006.

(51) Int. Cl.
*F01L 1/18* (2006.01)

(52) U.S. Cl. ..... 123/90.41; 123/90.39; 74/559

(58) Field of Classification Search ..... 123/90.39, 123/90.41, 90.42; 74/559
See application file for complete search history.

(56) References Cited

U.S. PATENT DOCUMENTS 5,063,889 A * 11/1991 Pryba et al. ..... 123/90.39
5,329,891 A * 7/1994 Murphy et al. ..... 123/90.39

* cited by examiner

*Primary Examiner*—Zelalem Eshete
(74) *Attorney, Agent, or Firm*—Lucas & Mercanti, LLP

(57) ABSTRACT

A rocker arm assembly for a valve train of an internal combustion engine which has a rocker arm that pivots on a support pin about an axis where a push rod contacts one end of the assembly and a valve shaft of a gas exchange valve contacts the other end of the assembly. A rocker arm is mounted on a support pin through a radial roller bearing for handling radial forces. An outer bearing support wall is attached to the rocker am and covers both ends of the support pin. Between the ends of the support pin and the outer bearing wall is a thrust washer for handling axial forces in the rocker arm assembly. The radial bearing assembly can have an outer bearing shell and an inner bearing shell where the outer bearing shell has a generally U-shaped configuration that covers the end wall of the support pin. The bottom wall of the outer bearing shell forms the outer bearing support wall for the thrust washer.

7 Claims, 6 Drawing Sheets

ROCKER ARM ASSEMBLY FOR RADIAL AND AXIAL LOADS

BACKGROUND OF THE INVENTION

1. Field of the Invention

This Invention relates to rocker arm assemblies for a valve train of an internal combustion engine, and more particularly, to a bearing arrangement used in a pedestal mounted rocker arm assembly used in a push rod style engine.

2. Related Art

Pedestal mounted rocker aim assemblies have a rocker arm rotatably mounted on a support pin and the support pin is fixed to the cylinder head through the pedestal. The support pin is also known as a trunnion. Typically, the support pin rests on a support block which positions the overall rocker am assembly away from the cylinder head. One end of the rocker arm is in contact with the push rod while the other end of the rocker arm is in contact with the valve shaft.

A radial bearing arrangement is formed between the support pin and the rocker am to facilitate rotational movement of the rocker arm on the support pin. The radial bearing arrangement handles the radial forces from the rocking motion of the rocker arm on the support pin.

Rocker arm assemblies can also be subject to axial forces. These axial forces can occur when certain parts are out of alignment, for example the rocker arm pallet and the socket, the lower end of the pushrod and the socket, or the value shaft and the rocker arm pallet.

One solution to handle axial forces in rocker arm assemblies is disclosed in U.S. Pat. No. 6,694,936, issued Feb. 24, 2004. The '936 patent uses an axial roller bearing arrangement to handle axial forces. In one embodiment taught in the '936 patent the axial roller bearing is positioned between the radial roller baring and the fastening bolt, and a thrust washer is positioned between the axial roller bearing and the fastening bolt.

There is a need to provide alternative arrangements for rocker arm assemblies that can handle both radial forces and axial forces.

SUMMARY OF THE INVENTION

The object of the invention is to configure a rocker arm assembly, and a bearing assembly for use in a rocker aim assembly for a valve train of an internal combustion engine such that both radial and axial forces are accommodated without difficulty.

The object of the invention is accomplished in accordance with the invention with a rocker arm assembly having a rocker arm rotatably mounted on a support pin by means of a radial bearing arrangement and an outer bearing support wall covers each end wall of the support pin and a thrust washer positioned between each end wall of the support pin and the outer bearing support wall. The rocker arm has two parallel, spaced apart, side walls in the region of the support pin. The rocker arm has a horizontal hole through the side walls to accommodate the support pin and a radial bearing arrangement. The radial bearing arrangement is positioned in the hole between the support pin and the rocker arm, at each end of the support pin, and aligned with each side wall. The outer bearing support wall is affixed to the rocker arm and extends downward along each side of the rocker arm to cover each end wall of the support pin. A cavity is created between the inner surface of the outer bearing support wall and the end wall of the support pin. The thrust washer is positioned in each cavity created by the outer bearing support wall and the end wall of the support pin.

The radial bearing arrangement facilitates radial forces while the thrust washer, outer bearing support wall and end wall of the support pin accommodate axial forces. The axial load is carried by the outer bearing support wall, the thrust washer and the end wall of the support pin. Thus, the large surface area of the end wall of the support pin acts as a bearing surface and provides a very stable and very strong rocker arm assembly when acted on by the thrust washer.

The bearing assembly of the invention comprises a bearing arrangement having an outer bearing shell and an inner bearing shell. The outer bearing shell has a U-shaped cross section wherein the outside of each sidewall of the U-shaped outer bearing shell is affixed to the inside of the horizontal hole in the rocker arm. The bottom wall of the U-shaped outer bearing shell forms the outer bearing support wall. The inner bearing shell has a U-shaped cross section. The bottom wall of the U-shaped inner bearing shell abuts axially the end wall of the support pin and the side walls of the U-shaped inner bearing shell are affixed radially to the support pin. Roller elements are positioned between the sidewalls of the U-shaped outer bearing shell and the side walls of the U-shaped inner bearing shell. A thrust washer is positioned between the bottom wall of the U-shaped inner bearing shell and the bottom wall of the U-shaped outer bearing shell.

In the bearing assembly of the invention, the inner bearing shell is positioned between the support pin and both the thrust washer and the radial roller elements. The outer bearing shell is positioned between the rocker arm and the roller elements and holds the thrust washer against the inner bearing shell.

Retention flanges for the radial roller elements are provided on the outer bearing shell, or the inner bearing shell, or both the inner bearing and the outer bearing shell.

The outer bearing support wall can be part of the outer bearing shell which forms the radial bearing or can be separate therefrom.

The U-shaped inner bearing shell can have a hole in the bottom wall and the thrust washer can have a T-shaped cross section, where the stem of the T-shaped thrust washer fits inside the hole in the bottom wall of the U-shaped inner bearing shell and the top of the T-shaped thrust washer is positioned between the bottom wall of the U-shaped inner bearing shell and the bottom wall of the U-shaped outer bearing shell.

The roller bearing elements can be balls, needles, or rollers.

The thrust washer is suitably made from polymers, metals, ceramics, and composite materials. Preferably, a polymer that needs minimal lubrication, works in high temperature environments and has a low coefficient of friction. There are commercially available polyamide-imide, high temperature thermoplastic resins, that can be used in the invention. One such polymer is TORLON®, which is available from Solvay Advanced Polymers LLC of Alpharetta, Ga. USA.

The thrust washer can be fixed or free to rotate and may be retained by a common fastener, grease, press fit or other mechanical entrapment means.

One or more thrust washers can be employed in the same cavity.

The outer bearing wall can be opened or closed in design but, an open design must have suitable flanges for load transfer to the thrust washer.

The rocker arm assembly can also be designed without the U-shaped inner bearing shell by hardening the side walls of the trunnion to function as the sidewalls of the U-shaped inner bearing shell and having the thrust washer in direct contact with the end wall of the trunnion.

These and other aspects of the invention may be more fully understood by reference to the following drawing and the detailed description of the invention.

BRIEF DESCRIPTION OF THE DRAWINGS

The invention will be described below with reference to the preferred embodiment in the drawings wherein.

DETAILED DESCRIPTION OF THE PREFERRED EMBODIMENT

Figure 1:
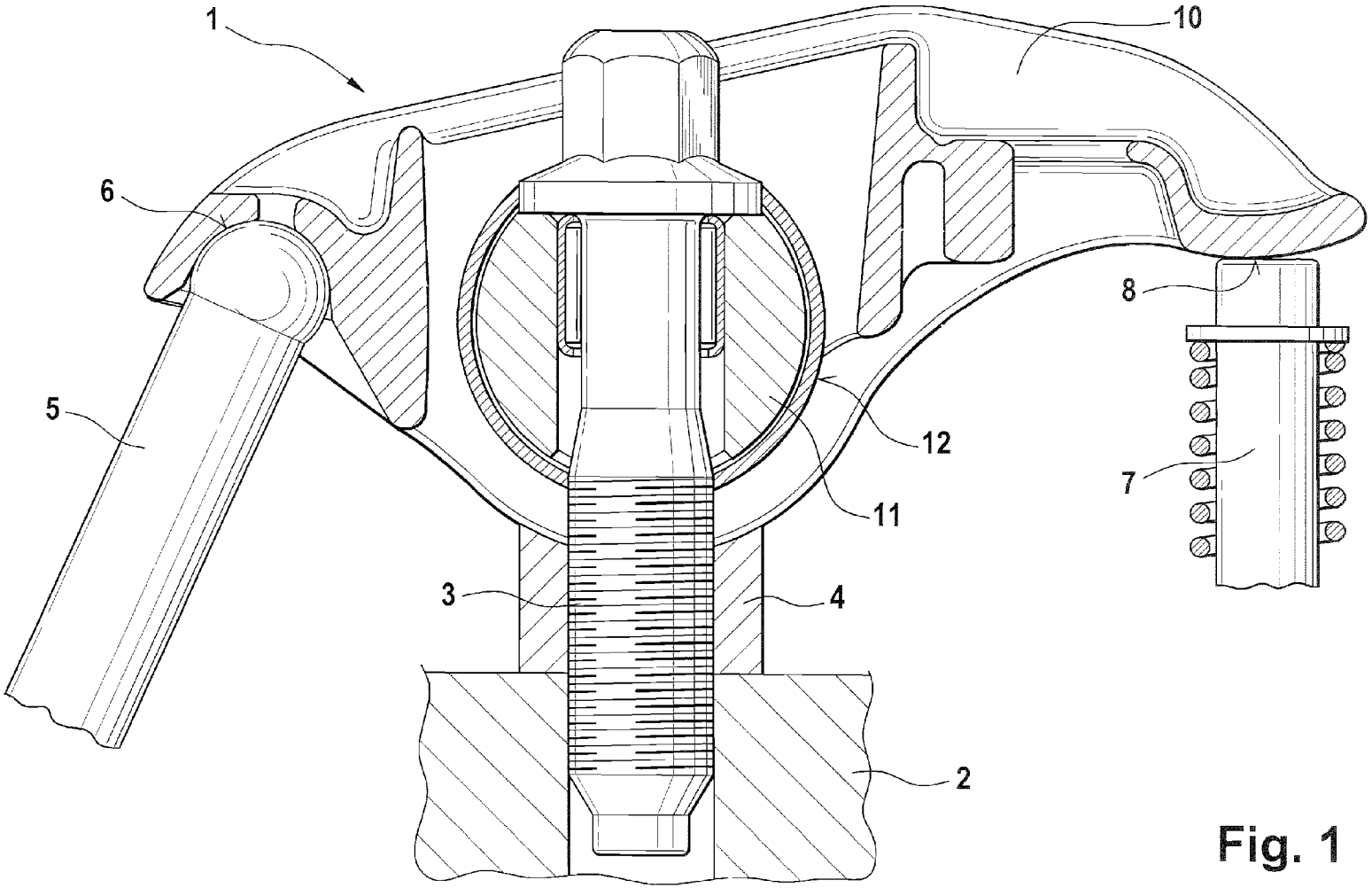
FIG. 1 is a side cross sectional view of the rocker arm assembly.

As shown in FIG. 1, rocker arm assembly 1 is affixed to cylinder head 2 by fastening bolt 3. Support block 4 positions the rocker am assembly 1 above cylinder head 2.

Push rod 5 contacts push rod ball socket 6 of rocker arm assembly 1 while valve shaft 7 contacts valve shaft end 8 of rocker arm assembly 1.

Rocker arm assembly 1 comprises a rocker arm 10 which rotates about support pin 11. Support pin 11 is held stationary by fastening bolt 3. Support pin 11 passes through horizontal hole 12 which is in rocker arm 10.

Figure 2:
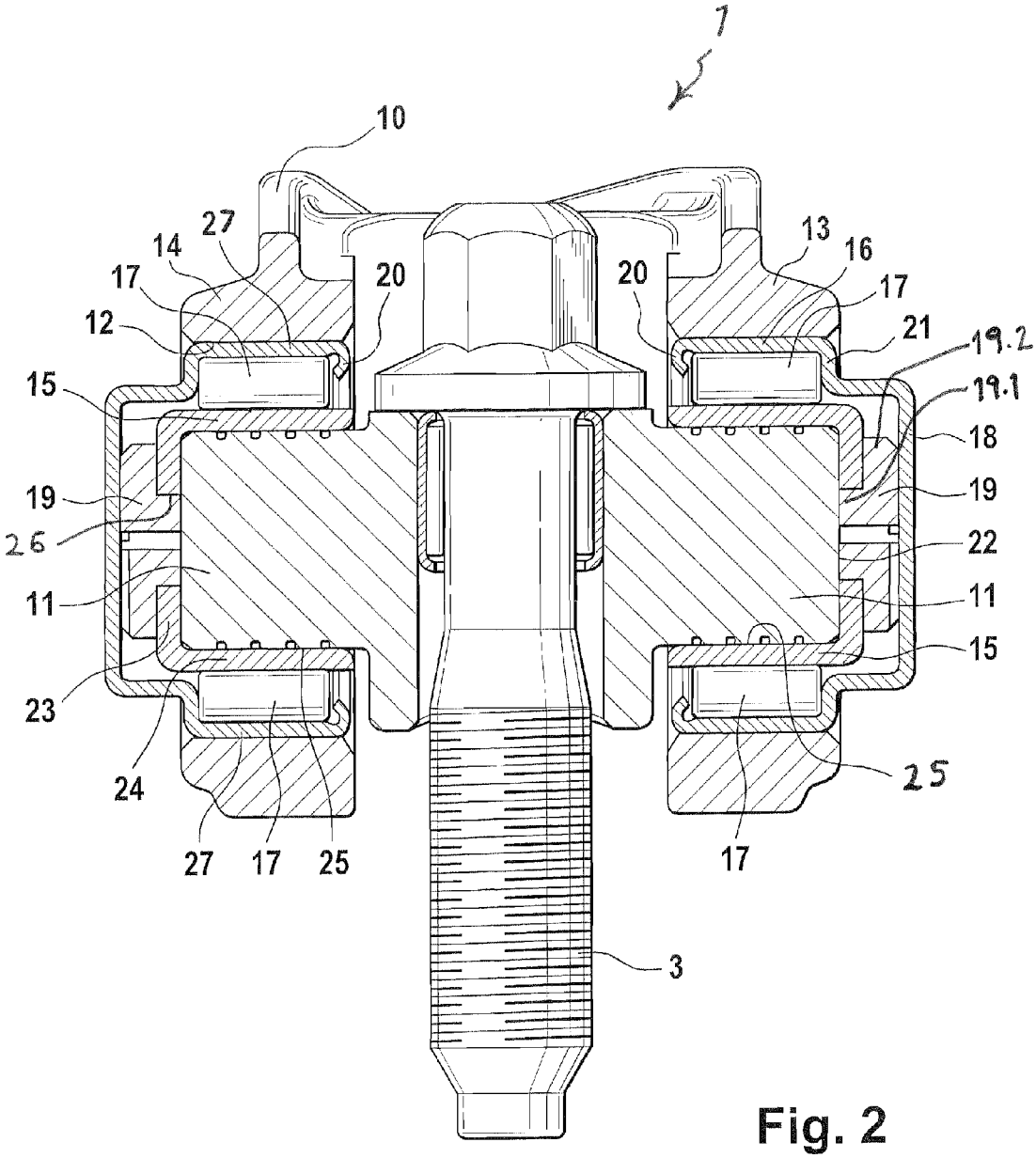
FIG. 2 is a front cross section view of the rocker arm assembly.

As shown if FIG. 2 horizontal hole 12 passes through rocker am wall 13 and rocker arm wall 14, thereby making a through hole in rocker arm 10.

A bearing assembly of the invention is made up of a radial bearing arrangement and an axial bearing arrangement. Specifically, inner bearing shell 15 is affixed to support pin 11. Outer bearing shell 16 is affixed to rocker arm 10. Roller bearings 17 are positioned between inner bearing shell 15 and outer bearing shell 16 in a radial manner to handle radial forces. Outer bearing support wall 18 is formed from the bottom wall of outer bearing shell 16. As can be seen, both inner bearing shell 15 and outer bearing shell 16 are generally U-shaped in cross section. Thrust washer 19 is positioned between outer bearing support wall 18 and the end wall 22 of support pin 11. Thrust washer 19 handles axial forces.

Outer bearing shell 16 has inner retention flange 20 and outer retention flange 21 for retaining roller bearings 17. End wall 22 of support pin 11 is affixed to bottom wall 23 of inner bearing shell 15. Side wall 24 of inner bearing shell 15 is affixed radially to radial wall 25 of support pin 11. Inner bearing shell 15 has hole 26 in bottom wall 23. Thrust washer 19 is T-shaped in cross section with stem 19.1 and top 19.2. Stem 19.1 fits in hole 26 and top 19.2 abuts bottom wall 23, as shown. Side wall 27 of outer bearing shell 16 are affixed to rocker arm 10.

Figure 3:
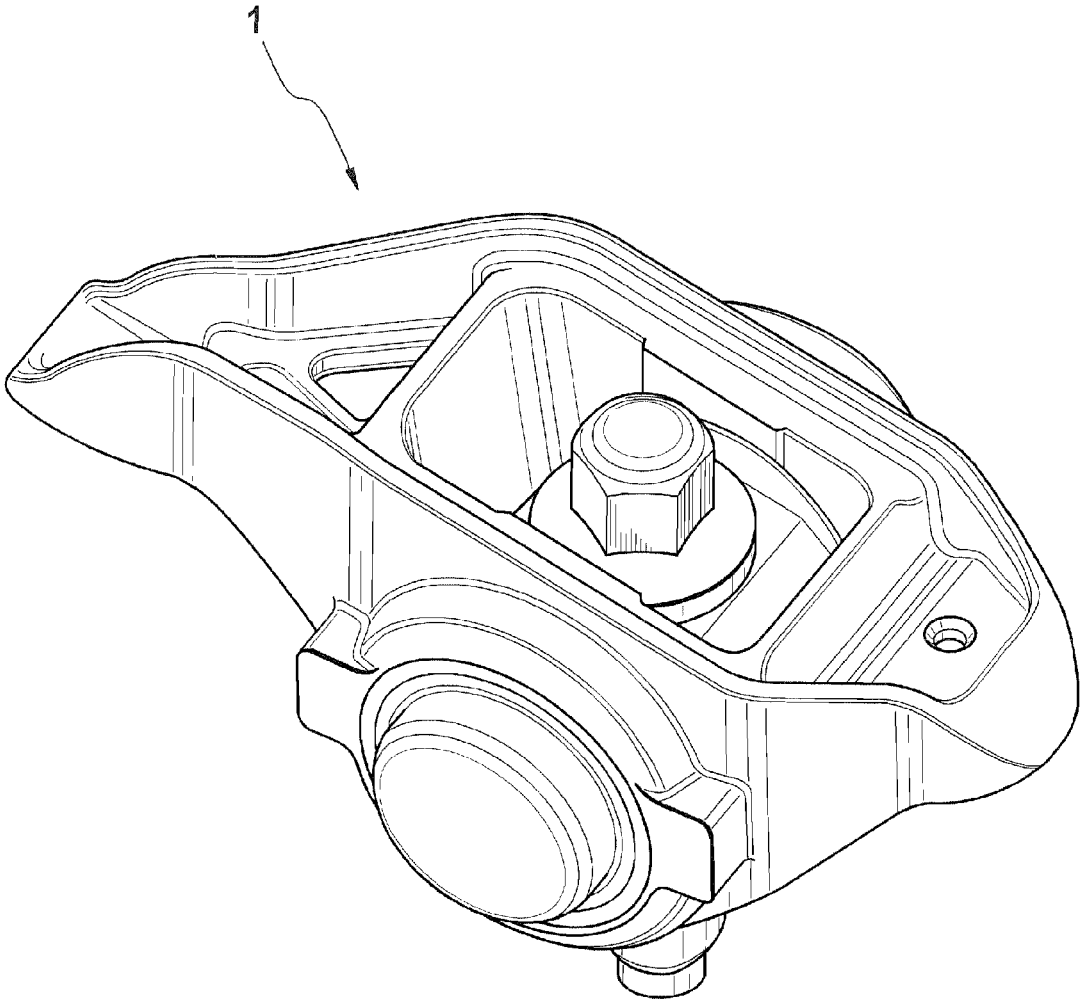
FIG. 3 is a perspective of the rocker arm assembly showing the offset.

FIG. 3 shows an offset in the rocker arm of the invention.

Figure 4:
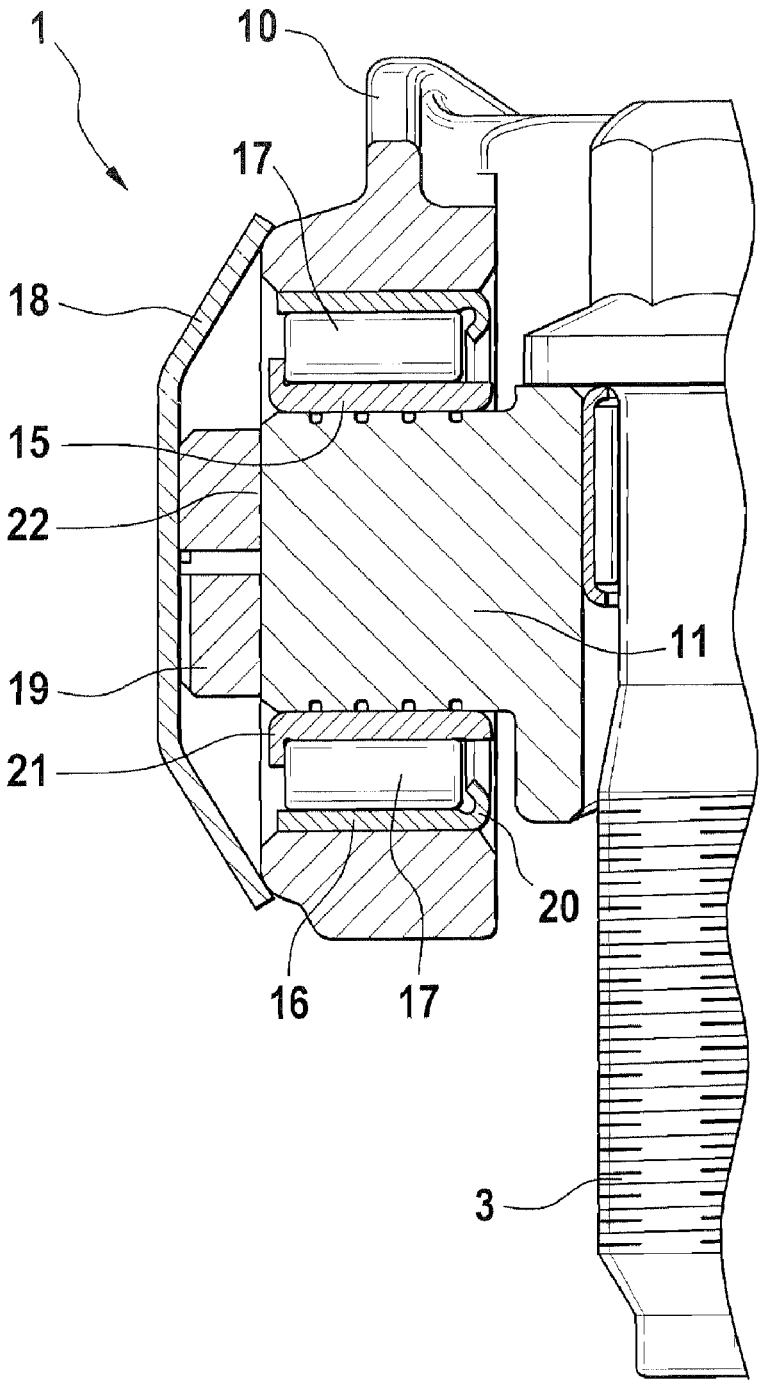
FIG. 4 illustrates the invention wherein the outer bearing wall is separate from the radial bearing assembly.

FIG. 4 illustrates outer bearing support wall 18 affixed to rocker arm 10, thrust washer 19 directly abutting end wall 22 of support pin 11, and inner bearing shell 15 with outer retention flange 21.

Figure 5:
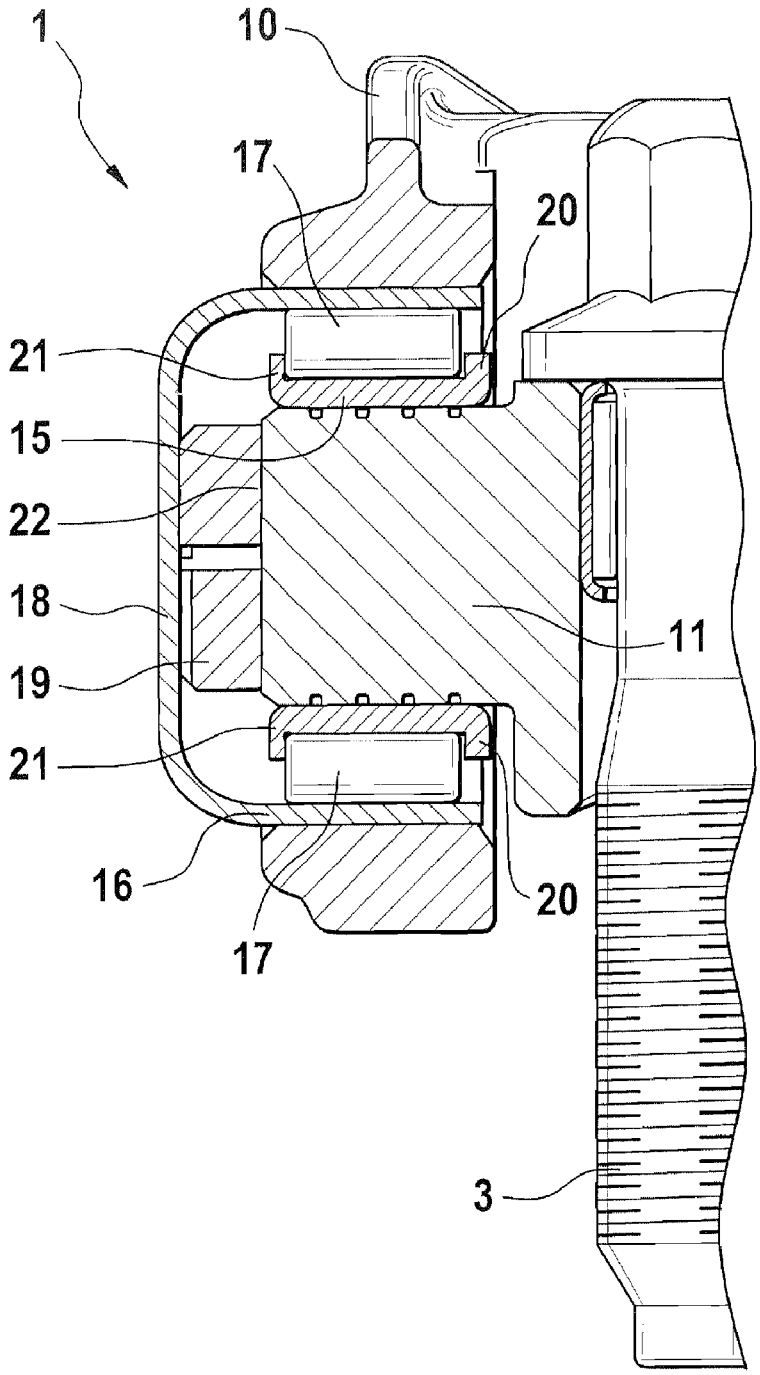
FIG. 5 illustrates the invention wherein the inner beating shell has outer retention flanges and the outer bearing shell has inner retention flanges.

FIG. 5 illustrates outer bearing support wall 18, part of outer bearing shell 16 and inner bearing shell 15 with both inner retention flange 20 and outer retention flange 21. Thrust washer 19 directly abuts end wall 22 of support pin 11.

Figure 6:
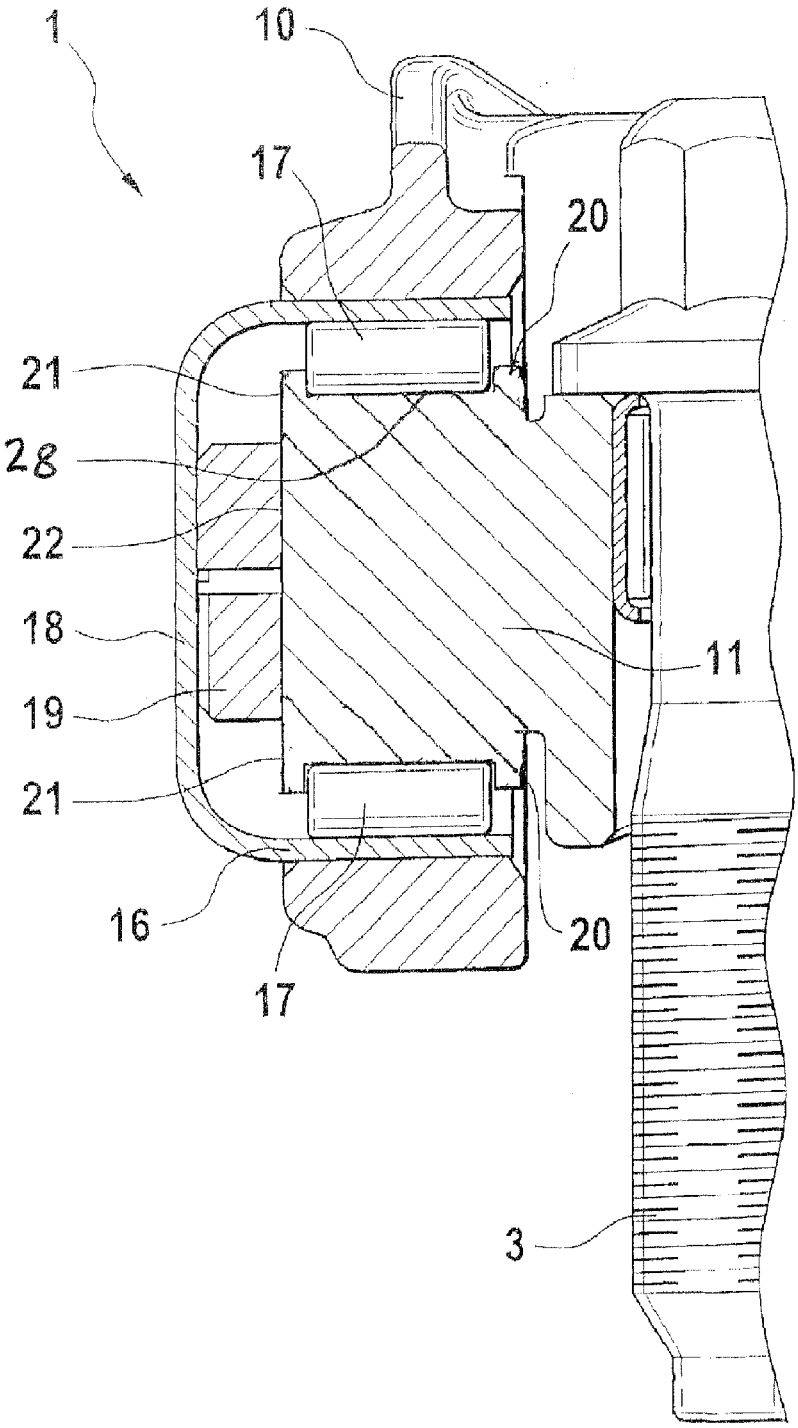
FIG. 6 illustrates the invention without an inner bearing shell, and the trunnion forms the inner race way for the radial bearing.

FIG. 6 illustrates the invention without inner bearing shell 15, where a race way 28 has been cut into radial wall 25 of support pin 11 and acts as a bearing surface for roller bearings 17. Inner retention flange 20 and outer retention flange 21 are cut from pin 11. Thrust washer 19 abuts end wall 22 and outer bearing support wall 18. In this embodiment pin 11 has radial wall 25 hardened to act as a race for roller bearings 17.

Such hardening is done in a conventional manner. In this embodiment, the bearing assembly in integral with the trunnion.

1 Rocker arm assembly
2 Cylinder head
3 Fastening bolt
4 Support block
5 Push rod
6 Push rod ball socket
7 Valve shaft
8 Valve shaft end
9
10 Rocker arm
11 Support pin
12 Horizontal hole
13 Wall rocker arm
14 Wall rocker arm
15 Inner bearing shell
16 Outer bearing shell
17 Roller bearing
18 Outer bearing support wall
19 Thrust washer
19.1 Stem
19.2 Top
20 Inner retention flange
21 Outer retention flange
22 End wall
23 Bottom Wall
24 Side Wall
25 Radial wall
26 Hole
27 Sidewall
28 Race way

The invention claimed is:

1. Rocker arm assembly for use in an internal combustion engine, where the assembly is pedestally mounted on the cylinder head in a push rod style engine, comprising:

a rocker arm, having a horizontal hole through said rocker arm;

a support pin positioned in said horizontal hole;

a radial bearing arrangement positioned between said support pin and said rocker arm in said horizontal hole so as to provide radial rotatable movement to said rocker arm;

an outer bearing wall extending downward from each side of said rocker arm and closing said horizontal hole, said outer bearing support wall forming a cavity between an end wall of the support pin and the outer bearing support wall; and, a thrust washer positioned in each cavity for accommodating axial forces in said rocker arm assembly, said thrust washer contacting the support pin only at an end wall of the support pin.

2. The rocker arm assembly of claim 1, wherein the outer bearing wall forms and outer bearing shell for the radial bearing arrangement.

3. The rocker arm assembly of claim 1, wherein the outer bearing wall is separate from the outer bearing shell for the radial bearing arrangement.

4. A bearing assembly for a rocker arm assembly having a rocker arm and a support pin mounted in a hole in the rocker arm, the bearing assembly comprising:

an outer bearing shell having a U-shaped cross section, wherein a side wall of the U-shaped outer bearing shell is affixable to the rocker arm in the hole in the rocker arm;

an inner bearing shell spaced apart from the outer bearing shell and having a U-shaped cross section, wherein a side wall of the U-shaped inner bearing shell is affixable to the support pin, the side wall of the inner bearing shell faces the sidewall of the outer bearing shell and a bottom wall of the inner bearing shell faces a bottom wall of the U-shaped outer bearing shell;

a roller element positioned between the side wall of the inner bearing shell and the side wall of the outer bearing shell; and, a thrust washer positioned between the bottom wall of the inner bearing shell and the bottom wall of the outer bearing shell.

5. The bearing assembly of claim 4, wherein the thrust washer is positioned between the bottom wall of the outer bearing shell and the end wall of the support pin and contacts both the end wall of the support pin and the bottom wall of the inner bearing shell.

6. A support pin assembly for a rocker arm of an internal combustion engine, comprising:

a support pin;

a race way positioned in at least one end of said support pin;

an outer bearing shell having a U-shaped cross section, wherein a side wall of the U-shaped outer bearing is positioned opposite said race way and a bottom wall of the U-shaped outer bearing shell is positioned opposite an end wall of the support pin;

a roller element positioned between the side wall of the outer bearing shell and the race way; and, a thrust washer positioned between the bottom wall of the outer bearing shell and the end wall of the support pin, said thrust washer contacting the support pin only at an end wall of the support pin.

7. A bearing assembly for a rocker arm assembly having a rocker arm and a support pin mounted in a hole in the rocker arm, the bearing assembly comprising:

an outer wall, extending from one bottom wall of the rocker arm assembly to another bottom wall of the rocker arm assembly, covering the hole in the rocker arm assembly wherein a side wall of the outer wall is affixable to the rocker arm on an outer surface of the rocker arm;

an inner bearing shell spaced apart from the outer bearing shell wherein a side wall of the-inner bearing shell is affixable to the support pin, a bottom wall of the inner bearing shell faces a bottom wall of the U-shaped outer bearing shell;

a separately formed outer bearing shell positioned on the inner surface of the hole in the rocker arm assembly;

a roller element positioned between the side wall of the inner bearing shell and the side wall of the outer bearing shell; and, a thrust washer positioned between the bottom wall of the inner bearing shell and the bottom wall of the outer bearing shell.

* * * * *